US005292084A

United States Patent [19]

Lofstrom

[11] Patent Number: 5,292,084

[45] Date of Patent: Mar. 8, 1994

[54] CORE SLIP APPARATUS FOR WINDING STRIPS INTO COILS

[76] Inventor: Roger J. Lofstrom, 151 S. Ridgedale Ave., East Hanover, N.J. 07936

[21] Appl. No.: 818,272

[22] Filed: Jan. 8, 1992

[51] Int. Cl.[5] ..... B65H 75/24

[52] U.S. Cl. ..... 242/56.9

[58] Field of Search ..... 242/56.9, 74.1, 68.1, 242/68.3; 226/190, 194

[56] References Cited

U.S. PATENT DOCUMENTS

| | | | |
|---|---|---|---|
| 3,322,361 | 5/1967 | Young | 242/56.9 |
| 3,424,394 | 1/1969 | Schmidt et al. | 242/56.9 X |
| 4,220,291 | 9/1980 | Papa | 242/56.9 |
| 4,693,431 | 9/1987 | Kataoka | 242/56.9 X |
| 5,161,747 | 11/1992 | Krämer | 242/56.9 |

*Primary Examiner*—Daniel P. Stodola
*Assistant Examiner*—Paul T. Bowen
*Attorney, Agent, or Firm*—Kane, Dalsimer, Sullivan, Kurucz, Levy, Eisele & Richard

[57] ABSTRACT

A core slip apparatus for winding strips into coils includes a roller sleeve mounted on an arbor. Cores mounted on the sleeve are used to form the coils as the arbor rotates. The roller sleeve prevents friction between the core and the arbor thereby insuring that the winding proceeds properly and is not affected by the weight of the coil.

15 Claims, 3 Drawing Sheets

CORE SLIP APPARATUS FOR WINDING STRIPS INTO COILS

BACKGROUND OF THE INVENTION a. Field of Invention

This invention pertains to an apparatus for winding elongated strips of material, such as metal strips, into a coil, and more particularly to an apparatus with a core slip member having roller sleeve for eliminating friction with the coil core.

b. Description of the Prior Art

Core slip winding devices are available commercially which, as shown somewhat schematically in FIG. 1, may consist of a rotating drum 2 which supports a plurality of cores 4 and a plurality of axially spaced separators 6. The last separator 6' is positioned against a solid plate 8. A spring 10 cooperates with a knob and screw arrangement 12 and 14 to apply an axial pressure on the cores 4 and separators 6. Separators 6 are keyed (by keying means not shown) to the drum 2 so that the separators and the drums are rotating together. The cores 4 have an inner diameter slightly larger than the outer diameter of drum to allow the cores 4 to slip with respect to the arbor as the drum rotates. This prior art mechanism may be disposed for example down stream of a slitting mechanism which continuously slits a wide sheet into narrow parallel strips 16. The ends of each of these strips 16 are secured to a core 4 so that as the strips 16 come off the slitter, the drum 2 is driven a speed slightly higher than the speed of the slitter allowing the strips to be wound simultaneously into individual coils by the apparatus of FIG. 1. Because the cores 4 are allowed to slip with respect to drum 2, each strip is allowed to wind at its own pace thereby compensating for the difference in thickness between the strips 16. The tension applied to each strip during winding is applied and controlled by the separators 6. One problem with this arrangement is that as more and more strip material 16 is wound on a core 4, the weight and the size of the coil increases thereby increasing the frictional force between the core 4 and the drum 2. As a result, when each coil strips becomes relatively large, especially if the strip 16 is made of a metal, and hence it is heavy, the tension on the strip is affected by the weight of the coil, resulting in an uneven coil.

OBJECTIVES AND SUMMARY OF THE INVENTION

It is an objective of the present invention to provide a slip winding apparatus in which the above-described disadvantage is eliminated.

Yet another objective is to provide a winding apparatus which is strong and reliable yet not too expensive.

Other objectives and advantages of the invention shall become apparent from the following description of the invention. A slip core winding apparatus constructed in accordance with this invention includes a rotating arbor and a roller sleeve secured to said arbor, said sleeve having an outer perimeter. Cores are mounted on said sleeve for accepting at least a strip for winding. The apparatus also includes support means for supporting said cores on said sleeve, said support means being arranged on said outer perimeter to permit said cores to rotate with respect to said sleeve substantially without friction. The apparatus further includes tensioning means mounted on said sleeve for applying tension to said strip thereby winding said strips on said cores as said arbor rotates.

DETAILED DESCRIPTION OF THE INVENTION

Figure 3:
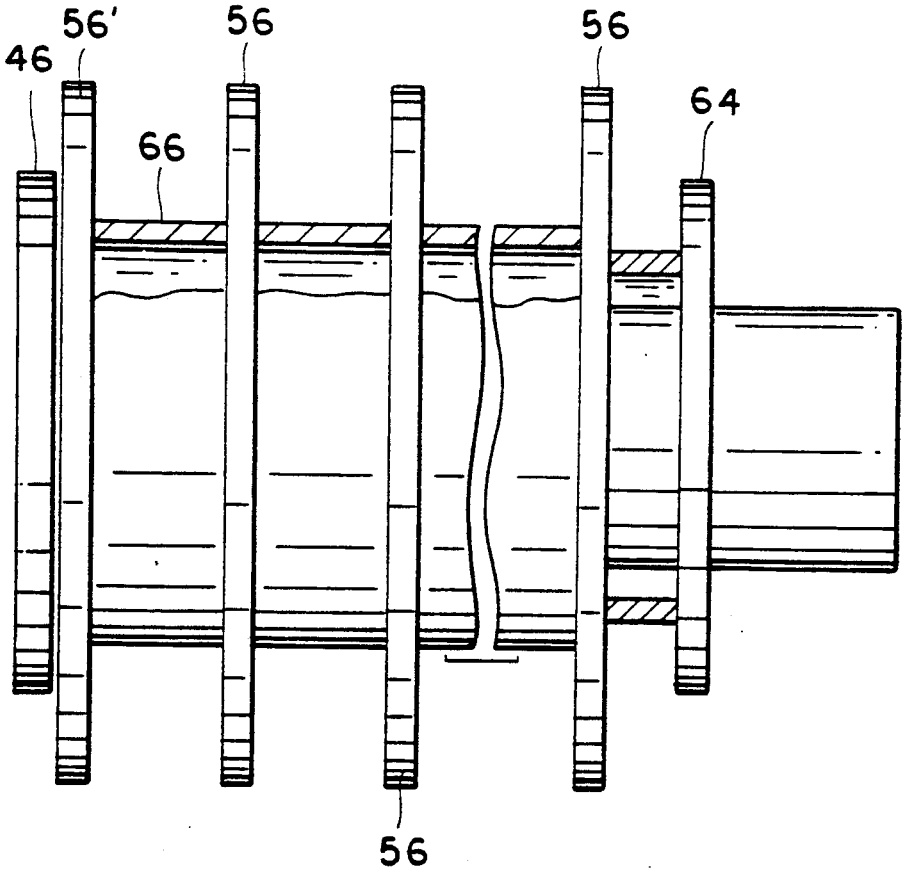
FIG. 3 shows a plan view of the apparatus of FIG. 2 during winding.
Figure 2:
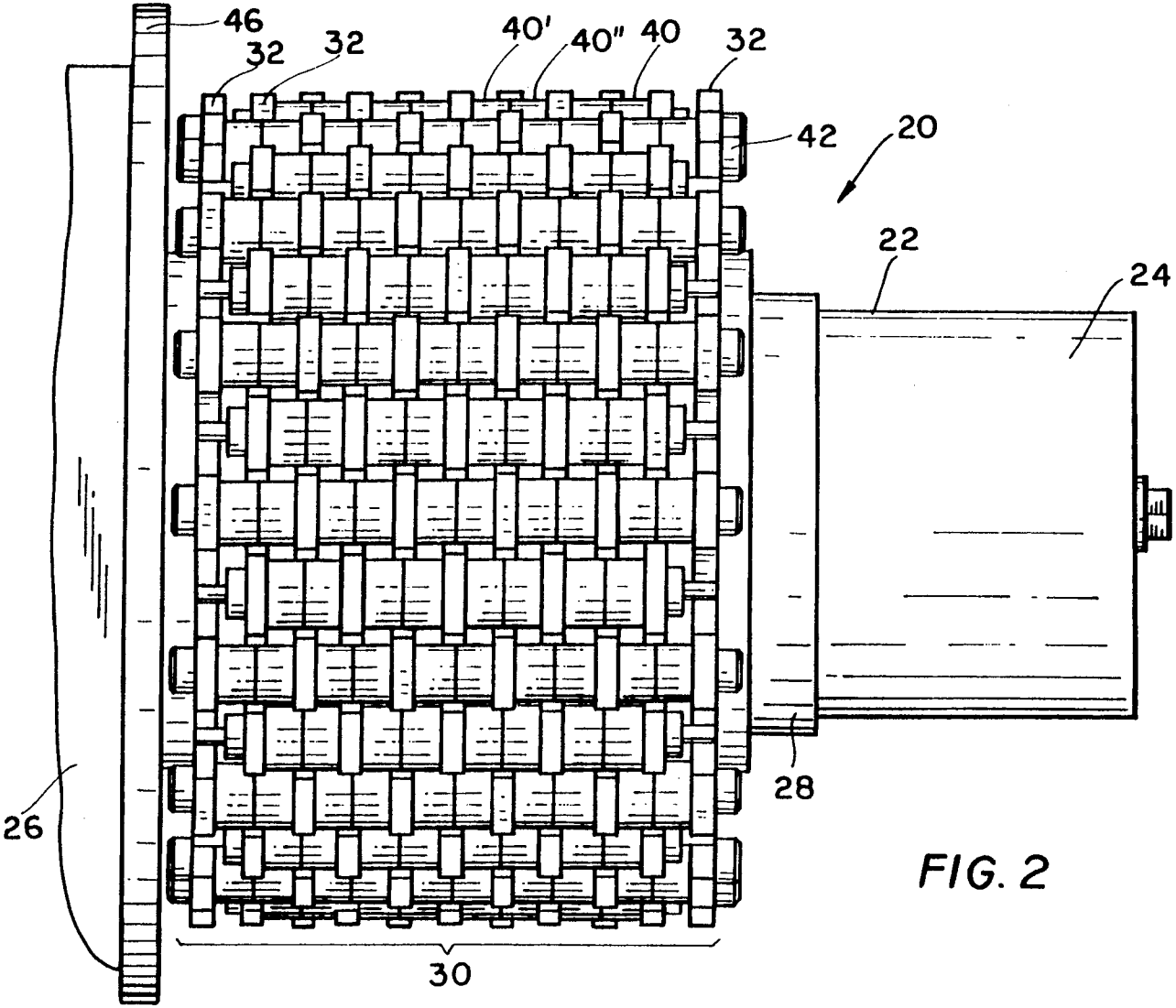
FIG. 2 shows a plan view of a core slip winding apparatus in accordance with the present invention, without the cores and the separator disks.
Figure 4:
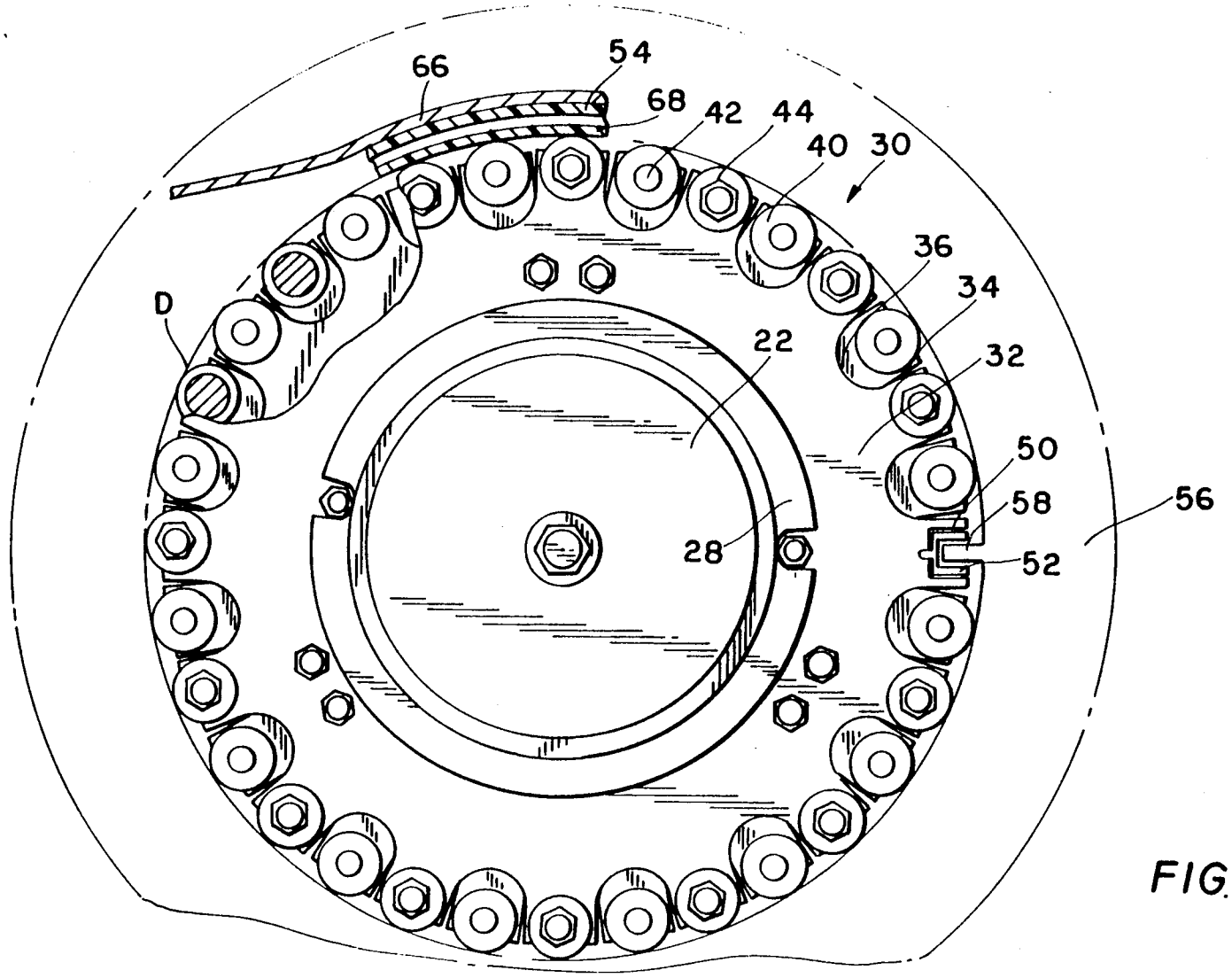
FIG. 4 shows an end view of the apparatus of FIG. 3 with the pretensioning member omitted.

FIGS. 2–4 show an apparatus 20 constructed in accordance with this invention and including a rotatable arbor 22. One end 24 of the arbor is left free so that the arbor can be rotated by a belt or other well known means. Arbor 22 is mounted on a stationary frame 26. Affixed to arbor 22 is a collar 28 which holds a rotary sleeve generally indicated in the drawings by 30.

The sleeve 30 is constructed from a plurality of plates such as plate 32 (FIG. 4). Each plate 32 is generally circular with a plurality of cutouts 34 formed peripherally around the plate. Each cutout is semicircular at its bottom as at 36. The plates 32 are spaced at a constant axial distance along arbor 22. Each plate 32 is angularly offset from the adjacent plate by an arc of circle equal to half the arc between adjacent cutouts 34. Sleeve 30 also includes a plurality of ball bearings 40. These ball bearings are arranged in pairs, such as 40' and 40'' with each bering pair being supported between two alternate plates 32. The plates 32 and ball bearings 40 are secured together by a plurality of rods 42 threaded at the ends and having securing nuts 44. As it can be seen in FIGS. 2 and 4, because of the arrangement of plates 32 the ball bearings 40 mounted on a particular rod 42 are axially offset from the bearings 40 mounted on an adjacent rod 42. The cutouts 34 are shaped so that a ball bearing is nested within each cutout with sufficient spacing between the ball bearing 40 and the cutout to permit the ball bearing to rotate freely around rod 42. In this manner a roller sleeve 30 is formed which is rotating with arbor 22, and which has an imaging cylindrical outer surface defined by freely rotating ball bearings 40.

Figure 1:
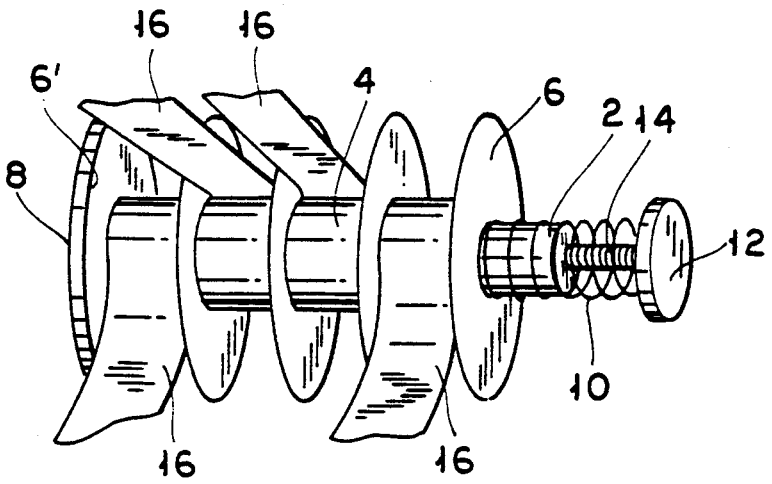
FIG. 1 PRIOR ART
FIG. 1 shows a somewhat schematic orthogonal view of a prior art core slip winding apparatus.

Adjacent to sleeve 30, there is a solid plate 46 mounted on arbor 22 which acts as a stop in a manner similar to plate 8 in FIG. 1.

Plates 32 are formed so at one position, along their periphery a rectangular cutout 50 is provided. The plates are arranged so that their rectangular cutouts 50 are aligned to form an axially extending slot holding on key way 52. A key way 52 made for example of sheet metal extends through this slot.

Before operating the apparatus 20, a plurality of tubular cores are mounted on the roller sleeve 30. These cores are preferably made of cardboard or other inexpensive material and have a diameter larger than the diameter of the imaginary cylinder. The cores may have the same axial length, or they may have different lengths to accommodate strips of different widths. Cores 54 are axially spaced by a plurality of separator disks 56. The disk 56' in the leftmost position as seen in FIG. 3 abuts plate 46. As shown in FIG. 4, each disk 56 is provided with a lug 58 extending radially inwardly into the keyway. When the separation disks 56 are mounted on roller sleeve 30, with lug 58 extending into the key way 52, the discs rotate with the sleeve 30 and arbor 22.

After the cores 56 and separate disks 58 are mounted on roller sleeve 30, a pretensioning mechanism 64 is mounted and activated on the arbor 22. This mechanism is used to apply axial tension on the separators and the cores by pneumatic, hydraulic or other means.

The apparatus operates as follows. First the ends of each of various strips are secured to a corresponding core. The arbor 20 is then rotated at a speed selected to exceed slightly (i.e. in the range of 5%) the nominal speed of the strips 66. As the arbor 22 rotates it starts turning separator disks 56 which in turn wind the strips on the cores. Because the strips are moving slower than the separator disks and the arbor, they force the core to turn at a lower speed also. However this differential speed is compensated by the rotating ball bearings 40 thereby avoiding friction between the cores 54 and the roller sleeve 30. It has been found that if the coil gets to be large and/or heavy, the repeated contact between the cores and the ball bearings may wear out and damage the cores. For example if the cores are made of several cardboard layers, these layers may separate. In order to avoid damage to the cores, tubular plastic inserts 68 may be placed inside the cores prior to the winding operation. In this manner contact between the cores and the ball bearings is avoided. Once a set of coils are wound on the cores, they may be removed from the arbor. The inserts 68 then may be retracted from the cores and reused.

Obviously numerous modifications may be made to this invention without departing from its scope as defined in the appended claims.

I claim:

1. A core slip apparatus for winding a strip of material into a coil comprising:

an arbor rotating about a longitudinal axis;

core means for accepting at least a strip for winding;

supporting means for supporting said core means, said support means being arranged to permit said core means to rotate with respect to said arbor substantially without friction, said support means comprising a plurality of mounting disks, a plurality of rods holding said mounting disks together and an outer perimeter defined by a plurality of bearing means being rotatably mounted on said rods, each bearing means having an axis of rotation radially spaced from said longitudinal axis; and tensioning means mounted on said support means for applying tension to said strip thereby winding said strip on said core means as said arbor rotates.

2. The apparatus of claim 1 wherein said bearing means comprises ball bearings.

3. The apparatus of claim 1 wherein said core means comprises a tubular core having two axially spaced ends and said tensioning means comprises a first and a second disk and adjacent to said first and second ends.

4. The apparatus of claim 3 wherein said first and second disks are rotating with said arbor.

5. An apparatus for winding several strips of material simultaneously into corresponding coils, said apparatus comprising:

a support frame;

an arbor mounted on said frame and rotating about a longitudinal axis;

a roller sleeve secured to said arbor, said roller sleeve having a plurality of mounting disks, a plurality of rods holding said mounting disks together and an outer perimeter with a plurality of bearings mounted on and freely rotatable with respect to said rods, each said bearing having an axis of rotation parallel with and radially spaced from said longitudinal axis;

core means disposed on said bearings, said core means being provided to wind several strips in parallel; and tensioning means mounted on said roller sleeve for tensioning said strips whereby said strips are wound on said core means as said arbor rotates.

6. The apparatus of claim 5 wherein said core means comprises a plurality of tubular cores axially spaced along said roller sleeve.

7. The apparatus of claim 6 wherein said tensioning means comprises a plurality of tensioning disks disposed normally to said longitudinal axis.

8. The apparatus of claim 7 further comprising coupling means for coupling said tensioning disks to said roller sleeve.

9. The apparatus of claim 6 further comrpising inserts disposed between said cores and said bearings.

10. The apparatus of claim 5 wherein said bearings are roller bearings.

11. The apparatus of claim 5 wherein said bearings have a bearing radius smaller than the radius of said arbor.

12. The apparatus of claim 11 wherein said axes of rotation are spaced from said longitudinal axis by a distance larger than said bearing radius.

13. An apparatus for winding several strips of material simultaneously into corresponding coils, said apparatus comprising:

a support frame;

a rotating arbor mounted on said frame;

a roller sleeve secured to said arbor, said roller sleeve having a plurality of mounting disks, a plurality of rods holding said mounting disks together, and an outer perimeter with a plurality of roller bearings journaled on said rods, said roller bearings being freely rotatable with respect to said roller sleeve;

core means disposed on said bearings, said core means being provided to wind several strips in parallel; and tensioning means mounted on said roller sleeve for tensioning said strips whereby said strips are wound on said core means as said arbor rotates.

14. The apparatus of claim 13 wherein said mounting disks are substantially circular with a plurality of cutouts, said roller bearings extending through said cutouts.

15. The apparatus of claim 14 wherein adjacent mounting plates are angularly offset.

* * * * *